US006663482B2

(12) United States Patent
Nottingham et al.

(10) Patent No.: US 6,663,482 B2
(45) **Date of Patent: *Dec. 16, 2003**

(54) MODULAR COIN HANDLING AND SORTING DEVICE

(75) Inventors: John R. Nottingham, Hunting Valley, OH (US); William J. Knox, Jr., Painesville, OH (US); John W. Spirk, Gates Mills, OH (US); Nicholas E. Stanca, Westlake, OH (US); Douglas A. Gall, Westlake, OH (US)

(73) Assignee: Mag-Nif Incorporated, Mentor, OH (US)

( * ) Notice: Subject to any disclaimer, the term of this patent is extended or adjusted under 35 U.S.C. 154(b) by 47 days.

This patent is subject to a terminal disclaimer.

(21) Appl. No.: 09/804,101

(22) Filed: Mar. 12, 2001

(65) Prior Publication Data

US 2001/0014581 A1 Aug. 16, 2001

Related U.S. Application Data

(63) Continuation of application No. 09/244,937, filed on Feb. 4, 1999.

(51) Int. Cl.[7] ..... G07D 3/00

(52) U.S. Cl. ..... 453/3; 453/9; 453/12; 453/13; 453/14; 453/15; 453/57

(58) Field of Search ..... 453/3, 9–15, 57

(56) References Cited

U.S. PATENT DOCUMENTS

| | | | | |
|---|---|---|---|---|
| 1,509,950 A | | 9/1924 | Hedrick | |
| 2,157,110 A | * | 5/1939 | Bock et al. | 198/453 |
| 2,163,082 A | | 6/1939 | Brandt | |
| 2,487,163 A | | 11/1949 | Miconi | |
| 3,064,789 A | | 11/1962 | Probasco | |
| 3,299,899 A | | 1/1967 | Nadherny | |
| 4,347,924 A | * | 9/1982 | Hayashi et al. | 194/346 |
| 4,558,712 A | | 12/1985 | Sentoku et al. | |
| 4,560,086 A | | 12/1985 | Stol | |
| 4,607,648 A | | 8/1986 | Hough | |
| 4,787,873 A | | 11/1988 | Borrmann et al. | |

(List continued on next page.)

OTHER PUBLICATIONS

Mag–Nif Makes it in the U.S.A.!—Banks, Games and Puzzles, Just for Fun! catalog (Front cover, pp. 1–14, back cover) (1998).

*Primary Examiner*—Donald P. Walsh
*Assistant Examiner*—Jeffery A Shapiro
(74) *Attorney, Agent, or Firm*—Fay, Sharpe, Fagan, Minnich & McKee, LLP

(57) ABSTRACT

A coin handling and sorting device includes a plurality of coin handling modules which are interconnectable by a user, as desired, to define a coin travel path. Each module is easily assembled by a user without use of tools. To facilitate assembly, bases, gears, retaining clips, and other components of different coin handling modules are interchangeable. The housing and other components of each module are assembled using a plurality of C-clips. Each module is typically manually operated to increase a user's interaction with the device. A clutch mechanism prevents accidental reverse operation of each module by a user. To facilitate interconnection of coin handling modules in any desired order, each has an inlet at a common height with other coin module inlets and an outlet at a common height with other coin module outlets. Each module also utilizes identical interchangeable modified spur/bevel gears that are shaped to accommodate co-planar engagement or angular displacement between engaged pairs. A coin connector interconnects the modules and includes a ramp in its inlet to flip coins onto their edges so that they roll to a downstream module. The connectors are pivotable relative to the modules to allow for varied placement of the modules and to facilitate construction of an endless loop coin travel path.

14 Claims, 14 Drawing Sheets

U.S. PATENT DOCUMENTS 5,007,876 A 4/1991 Klitsner
5,170,874 A * 12/1992 Abe ..... 193/DIG. 1
5,222,583 A * 6/1993 Bergmann et al. ..... 194/206
5,232,398 A * 8/1993 Maki ..... 198/397.01
5,474,496 A 12/1995 Perkitny
5,554,070 A * 9/1996 Takatoshi et al. ..... 134/131
5,827,117 A 10/1998 Naas
5,902,178 A * 5/1999 Perkitny ..... 453/61
6,086,471 A * 7/2000 Zimmermann ..... 221/312 R
6,095,916 A * 8/2000 Tamaki ..... 198/624
6,099,401 A * 8/2000 Perkitny ..... 453/61
6,165,063 A * 12/2000 Perkitny ..... 453/61
6,267,663 B1 * 7/2001 Nottingham et al. ..... 194/344

* cited by examiner

FIG. 3B
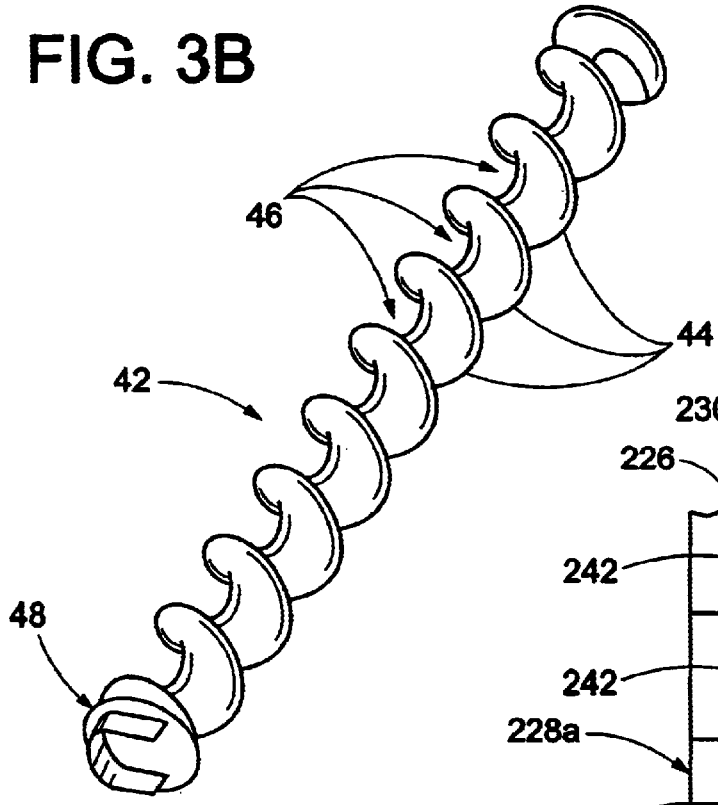
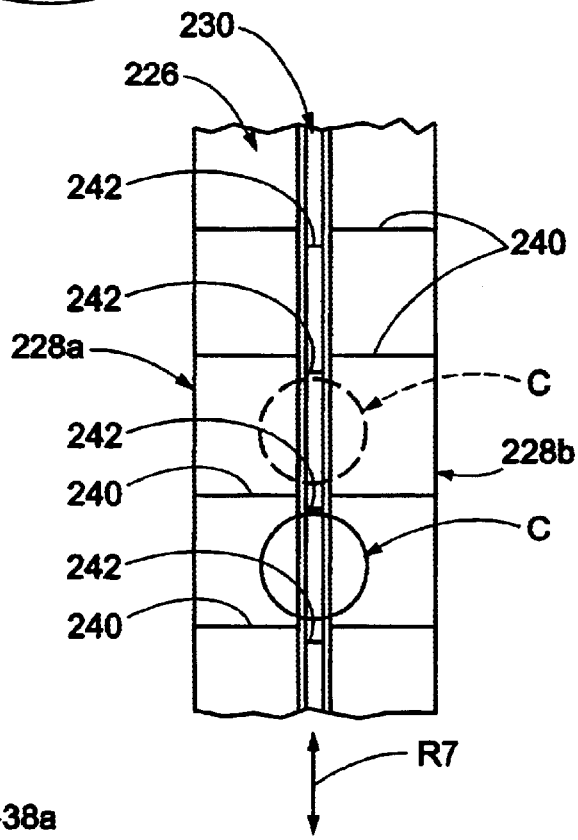
FIG. 8
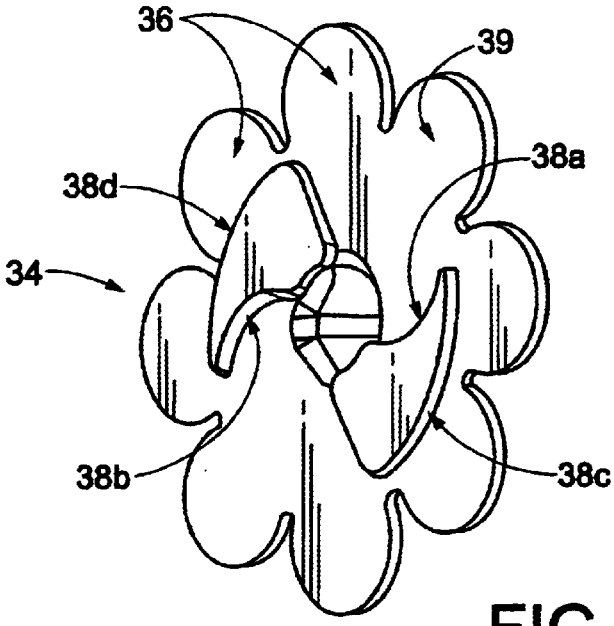
FIG. 3C

MODULAR COIN HANDLING AND SORTING DEVICE

CROSS-REFERENCE TO RELATED APPLICATION

This application is a continuation of U.S. application Ser. No. 09/244,937 filed Feb. 4, 1999.

BACKGROUND OF THE INVENTION

The present invention relates to the art of coin handling and sorting. More particularly, the present invention relates to a modular device for receiving unsorted coins, transporting the coins through a complex path, and sorting the coins by size into conventional coin wrappers or containers.

Coin sorting devices are useful for quickly and easily sorting and packaging coins of different denominations. Typically, coin sorting devices receive a plurality of differently denominated coins and direct each of the coins to the appropriate one of a plurality of coin wrappers or other containers based upon coin diameter. Such devices operate by causing coins to be moved along a predetermined path which has multiple sorting slots; one for each size of coin to be sorted and arranged in order of increasing size along the coin travel path. In operation, each coin drops through the first slot encountered which accommodates that coin's diameter and into a coin wrapper or container.

U.S. Pat. No. 5,474,496 to Perkitny discloses a coin sorting device including a coin receiver into which a plurality of unsorted coins are deposited. A motorized separator mechanism lifts individual coins from the receiver and deposits same onto an upper portion of a helical coin path. The coins roll downwardly on the path where they encounter the coin-receiving apertures arranged in order of increasing size. Upon encountering the first sufficiently sized aperture, a coin will pass therethrough and into a waiting coin container and/or wrapper. Devices such as that disclosed in the Perkitny '496 patent have commonly been manufactured from clear or transparent plastic so that the coins may be clearly perceived as they travel from the coin receiving area to the sorted coin containers to provide amusement for an operator of the device.

Prior coin sorting devices have typically been entirely self-contained and not suitable for use together with other coin handling or sorting devices to provide a kinetic art form in the manipulation of coins. Therefore, their amusement and entertainment value has been somewhat limited due to the repetitious nature of the coin sorting operation. Furthermore, these prior coin sorting devices have not included an exit path for the coins other than into sorted coin wrappers or containers, i.e., these prior devices have not been designed to communicate coins to an adjacent or downstream coin handling/sorting device. Thus, they could not be rearranged to alter the manipulation sequence of the coins. Also, these prior devices have typically been motorized and/or operated solely under force of gravity so that, once a user placed the unsorted coins in the receiver, the user was relegated to the role of simply observing the coin handling and/or sorting operation. The user could not, himself, power the coin sorter. Obviously, over time, mere passive observation of coin handling/sorting operations can become tedious and uninteresting.

Prior coin handling/sorting devices have also been at least substantially pre-assembled using screws and other conventional fasteners requiring tools. Therefore, these prior devices could not be conveniently assembled and/or disassembled by a user as desired, at least not without use of tools. Therefore, these prior devices did not provide users, such as children, with a detailed understanding of their inner-workings for purposes of learning mechanical principles.

In light of the foregoing and other deficiencies associated with these prior coin handling and sorting devices, it has been deemed desirable to develop a modular coin handling and sorting device which is easily assembled by a user without use of tools, which allows a user to participate in the coin handling/sorting operation, which may be interconnected with one or more coin handling/sorting devices in any desired order to vary the coin path, and which provides a complex and varied coin travel path to increase a user's amusement and enjoyment of the device.

SUMMARY OF THE INVENTION

In accordance with the present invention, a new and improved modular coin handling and sorting device is provided.

In accordance with a first aspect of the present invention, a coin handling device includes a plurality of coin handling modules, each comprising an inlet for receiving coins, an outlet for dispensing coins, and a coin transport mechanism for conveying coins individually from the inlet to the outlet. At least one coin connector extends between an outlet of an upstream module and an inlet of a downstream module and is adapted for conveying coins from the outlet of the upstream module to the inlet of the downstream module. A coin sorter has an unsorted coin inlet in communication with the outlet of one of the modules for sorting coins received therefrom.

In accordance with a more limited aspect of the invention, the coin handling device further includes a plurality of bases for respectively supporting the plurality of modules above a support surface. Each base includes a first boss for rotatably supporting an input gear, and an input gear is rotatably supported thereon. A stem projects upwardly from the input gear so that a user can grasp the stem to rotate the input gear.

In accordance with another aspect of the invention, a coin handling device includes a support base including a first boss for rotatably supporting an input gear, and an input gear rotatably supported on the base. A stem projects upwardly from the input gear for grasping by a user to effect rotation thereof. A coin handling module is supported by the base and includes (i) a coin inlet, (ii) a coin outlet, and, (iii) a coin transport mechanism adapted for transporting coins from the inlet to the outlet in response to rotation of the input gear.

In accordance with still another aspect of the invention, a coin handling module includes a support base and a housing supported on the base. The housing includes (i) a coin inlet, (ii) a coin outlet, and, (iii) a coin transport mechanism adapted for transporting coins from the inlet to the outlet. A drive system is manually operable by a user of the coin handling module and is operatively connected to the transport mechanism.

In accordance with yet another aspect of the present invention, an apparatus for handling coins includes first and second coin handling modules each having (i) an inlet for receiving coins, (ii) an outlet for dispensing coins, and, (iii) a coin transport mechanism for conveying coins individually from the inlet to the outlet. A coin connector includes a connector inlet connected to the outlet of the first module and a connector outlet connected to the inlet of the second module so that coins are conveyed thereby from the first module to the second module. The coin connector further includes (i) a coin transport channel connecting the connector inlet and connector outlet. The channel is conformed to support coins on their edges so that coins roll from the connector inlet to the connector outlet. A coin deflecting ramp is associated with the connector inlet and inclined downwardly toward the coin transport channel for deflecting coins deposited into the connector inlet onto their edges as the coins pass from the inlet to the channel.

One advantage of the present invention is that it provides a new and improved modular coin handling and sorting device.

Another advantage of the present invention is the provision of a modular coin handling system which is easily assembled and disassembled without use of tools and wherein bases, gears, retaining clips, and other components of different coin handling modules are interchangeable.

A further advantage of the present invention is the provision of a coin handling system which can be manually operated or motorized to increase a user's interaction with the device.

Still another advantage of the present invention resides in the provision of a coin handling device which includes a plurality of different coin handling and/or sorting modules which may be interconnected, arranged, and rearranged in a wide variety of different configurations to provide increased enjoyment.

A still further advantage of the present invention is the provision of a modular coin handling device wherein each of the coin handling modules has an inlet at a common height with other coin module inlets and an outlet at a common height with other coin module outlets so that the modules may be easily interconnected in any desired order.

A yet further advantage of the present invention is found in the provision of a modular coin handling device which may be constructed and utilized so as to circulate coins in an endless loop for amusement and learning purposes.

Another advantage of the present invention is that proper manual operation of a coin handling module is facilitated via a clutch mechanism which prevents accidental reverse operation of the coin handling module.

A further advantage of the present invention is the provision of a modular coin handling system in which each module utilizes identical interchangeable modified spur/bevel gears that are shaped to accommodate co-planar engagement or angular displacement between engaged pairs.

Still other benefits and advantages of the invention will become apparent to those skilled in the art upon reading and understanding the following specification.

BRIEF DESCRIPTION OF THE DRAWINGS

The invention may take form in certain components and structures, preferred embodiments of which will be illustrated in the accompanying drawings wherein:

FIG. 3B is a perspective view of an auger coin lifting mechanism used in the first coin handling module shown in FIG. 1;

FIG. 3C is a perspective view of the drive-disc used in the first coin handling module shown in FIG. 1;

FIG. 8 is a partial top plan view of a coin indexing ramp portion of the third coin handling module illustrated in FIG. 7 and taken along view line 8—8;

DETAILED DESCRIPTION OF THE INVENTION

Figure 1:
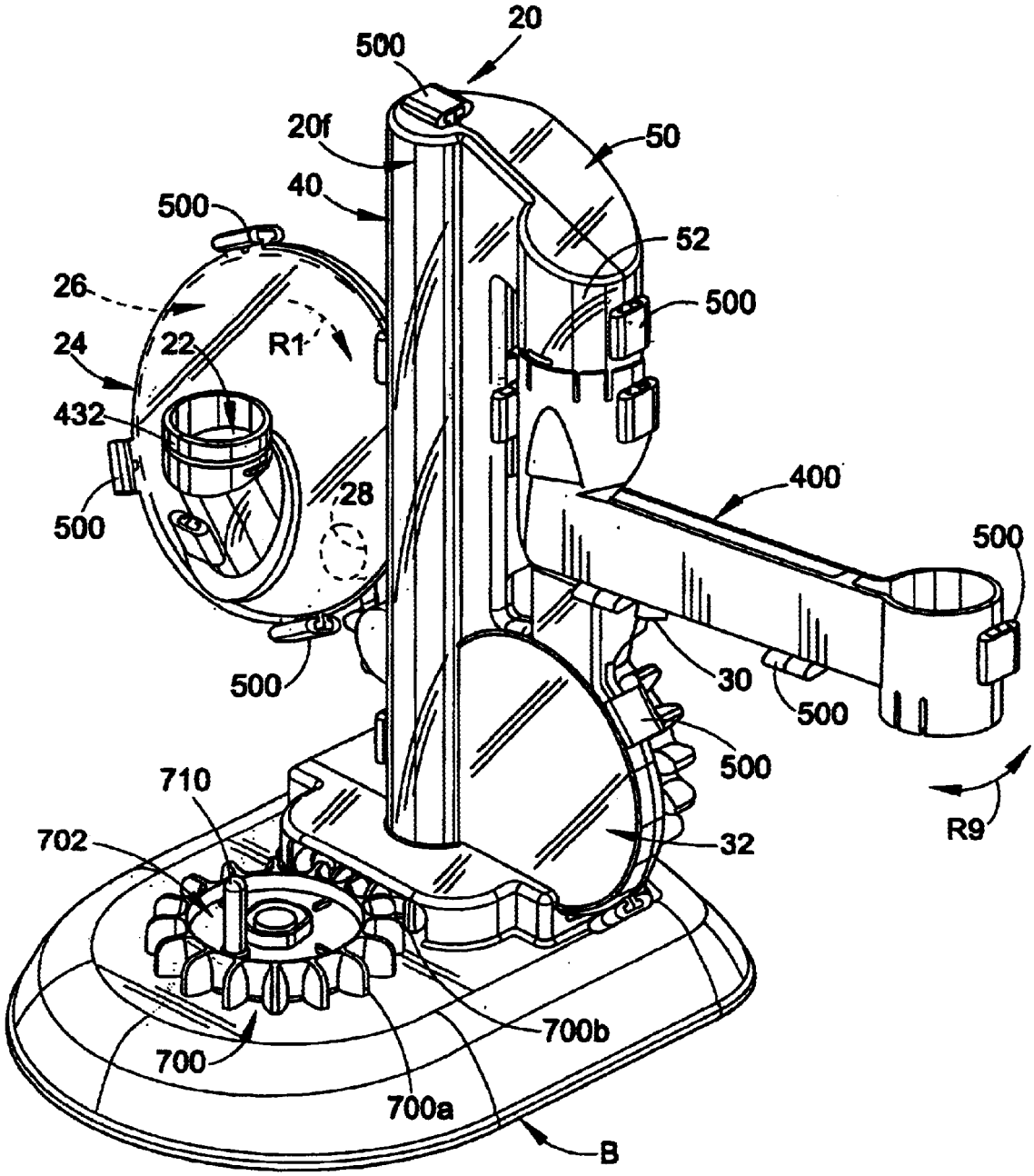
FIG. 1 is a perspective view of a first coin handling module in accordance with the present invention.

Referring now to the drawings, wherein the showings are for purposes of illustrating preferred embodiments only and not for purposes of limiting same, FIGS. 1–3C illustrate a first coin handling module 20 in accordance with the present invention. The first module 20 is supported on a base B and comprises a coin inlet 22 adapted for receiving coins of any denomination. The coin inlet is in communication with the interior of a coin disc housing 24 wherein a coin disc 26 is rotationally supported between a front housing wall 24*f* and a rear housing wall 24*r*. The coin disc includes an opening 28, such as an aperture or notch, large enough in size to receive the largest diameter coin to be sorted. The housing 24 is inclined rearwardly from vertical so that coins entering the inlet 22 fall onto the disc 26. When the disc rotates (as indicated by the arrow R1) the opening 28 eventually passes underneath and communicates with the coin inlet 22 so that a coin enters the opening 28. Depending upon the orientation of the coin, either the front or rear face of the coin received in the opening 28 will be supported against the housing rear wall 24*r* so that the coin is moved with the disc 26 in the opening 28.

It is important that the disc 26 lie closely adjacent the rear wall 24*r* to prevent a coin from sliding between the disc and the wall 24*r*. Also, the thickness of the disc 26, and the closeness of the wall 24*r* thereto, must be controlled so that one and only one coin is received in the opening 28 at any given time—i.e., the disc "strips" individual coins from the coin inlet 22. Thus, with respect to coins from The United States of America, the disc 26 must be thick enough so that a quarter is able to be received in the opening 28 and pass between the walls 24*f*,24*r* without difficulty. On the other hand, the disc 26 must be thin enough so that only one coin is able to be accommodated in the opening 28 and pass between the walls 24*f*,24*r*. For example, this prevents two dimes from being received simultaneously in the opening 28 and being conveyed by the disc 26. Although shown herein with one opening 28, the disc 26 can also be provided with two, three, or more openings 28 to receive coins from the inlet 22 for purposes of more rapidly conveying coins.

Once a coin is transferred from the coin inlet to the opening 28 of the disc 26, further rotation R1 of the disc causes the disc to carry the coin in the aperture 28 until the opening communicates with a coin chute 30 at the upper portion of the housing rear wall 24*r*. Because the housing 24 is rearwardly inclined, a coin in the opening will pass therethrough and into the chute 30. The chute 30 is arranged and conformed so that a coin deposited therein from the disc 26 will roll on its edge downwardly to a drive-disc housing 32 and drop therein under force of gravity.

The drive-disc housing 32 includes a drive-disc 34 supported therein for rotation as indicated by the arrow R2. The drive-disc includes a plurality of circumferentially spaced peripheral petals 36 and first and second coin receiving regions 38*a*,38*b* extending outwardly from a first face 39 thereof. A coin entering the drive-disc housing 32 from the chute 30 drops into one of the coin receiving regions 38*a*,38*b* and is carried by rotation R2 of the drive-disc to the region of a coin screw or auger housing 40—i.e., the coins in the regions 38*a*,38*b* drop out same when the disc 34 rotates sufficiently so that the coins pass to the auger housing 40. To ensure that the coins are properly passed to the auger housing 40, first and second coin pushing or cam surfaces 38*c*,38*d* are also defined to extend outwardly from the face 39 of the disc 34. Those of ordinary skill in the art will recognize that as the disc 34 rotates R2, a coin that falls from a region 38*a*,38*b* will be pushed by the surface 38*d*,38*c*, respectively, into the auger housing 40 upon further rotation R2.

The coin auger housing 40 contains a coin screw or auger 42 supported for rotation therein about its longitudinal axis as indicated by the arrow R3. The coin auger includes helical threads 44 that are spaced sufficiently far apart to accommodate the diameter of the largest coin to be handled. In this manner, coins passing from the drive-disc housing 32 to the auger housing 40 are received in the spaces 46 defined between adjacent sections of the helical threads 44. These coins are conveyed upwardly in the chamber 40 by rotation R3 of the auger 42. Also, it should be noted that the petals 36 of the drive-disc successively mate with the auger 42 by being received in the spaces 46 when the auger 42 and drive-disc 34 rotate. In this manner, rotation R3 of the auger 42 causes rotation R2 of the drive-disc 34.

As the auger 42 rotates, coins in the spaces 46 are conveyed upwardly to a coin exit chute 50 of the first module 20. The chute 50 slopes downwardly toward a coin outlet 52 and is conformed so that coins entering the chute 50 from the auger housing 40 roll on their edges to the coin exit 52 where they fall out of the module 20 under force of gravity for passage to an adjacent or connected module.

Figure 4:
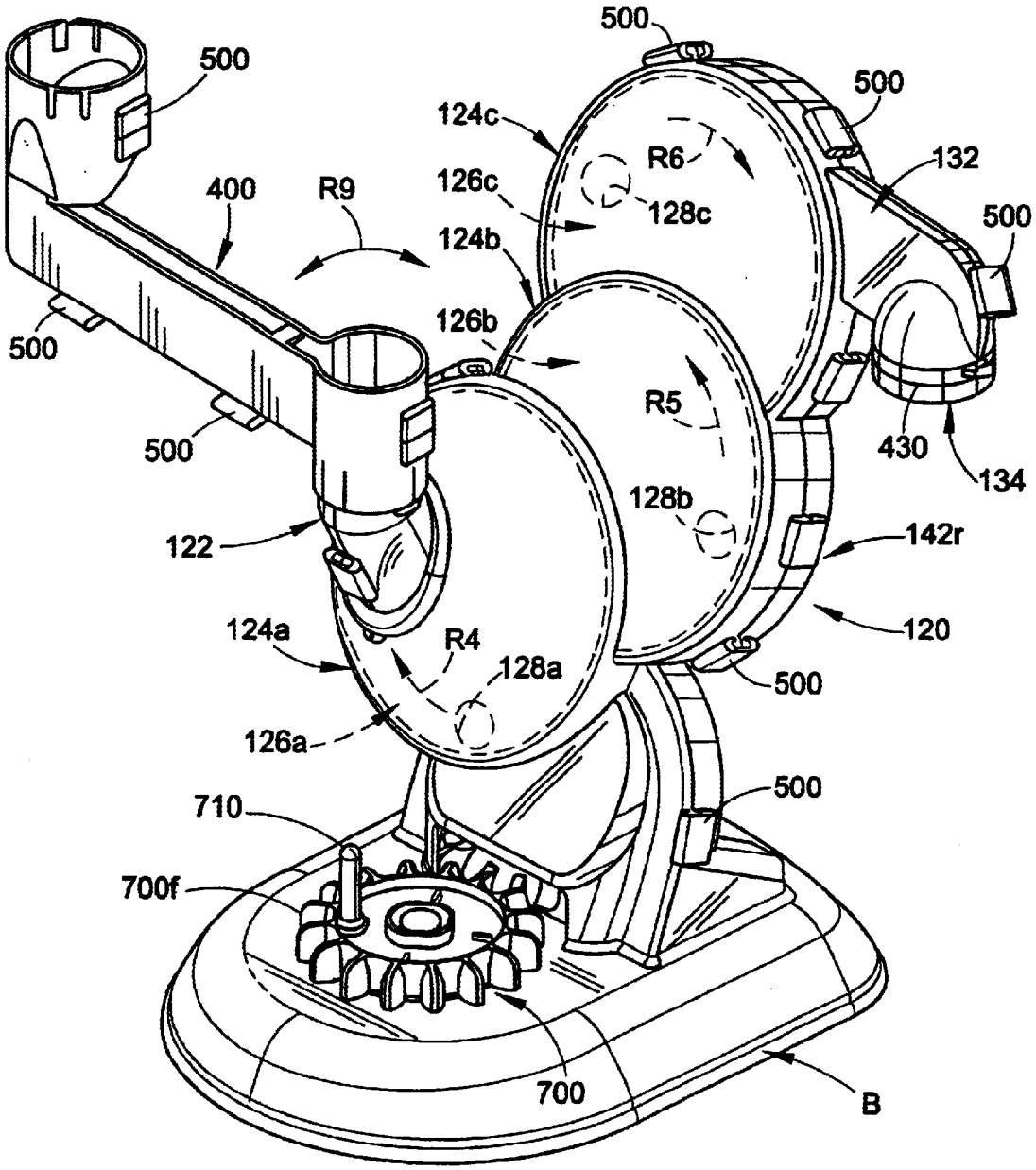
FIG. 4 is a perspective view of a second coin handling module in accordance with the present invention.
Figure 5:
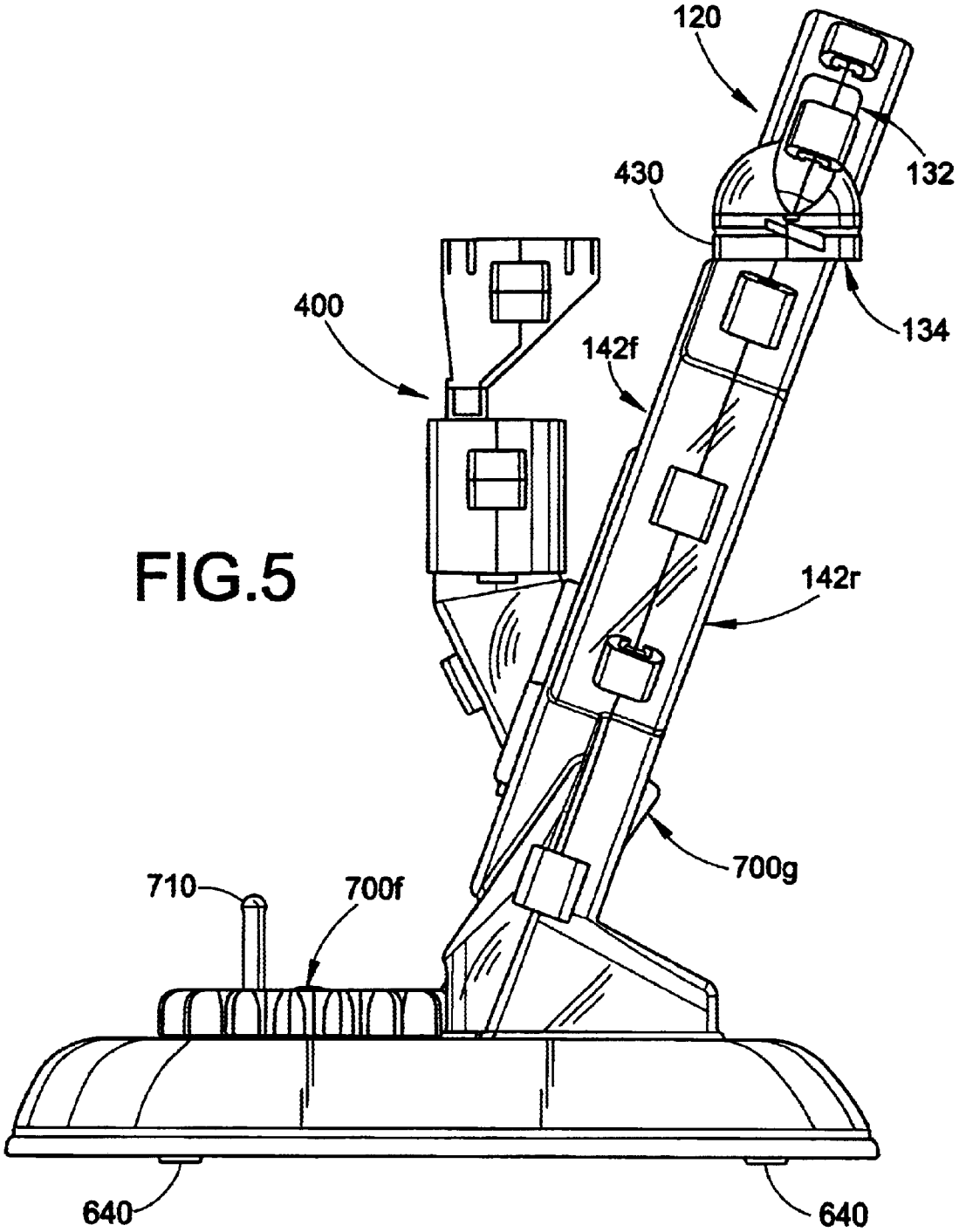
FIG. 5 is a side elevational view of the second coin handling module shown in FIG. 4.
Figure 6:
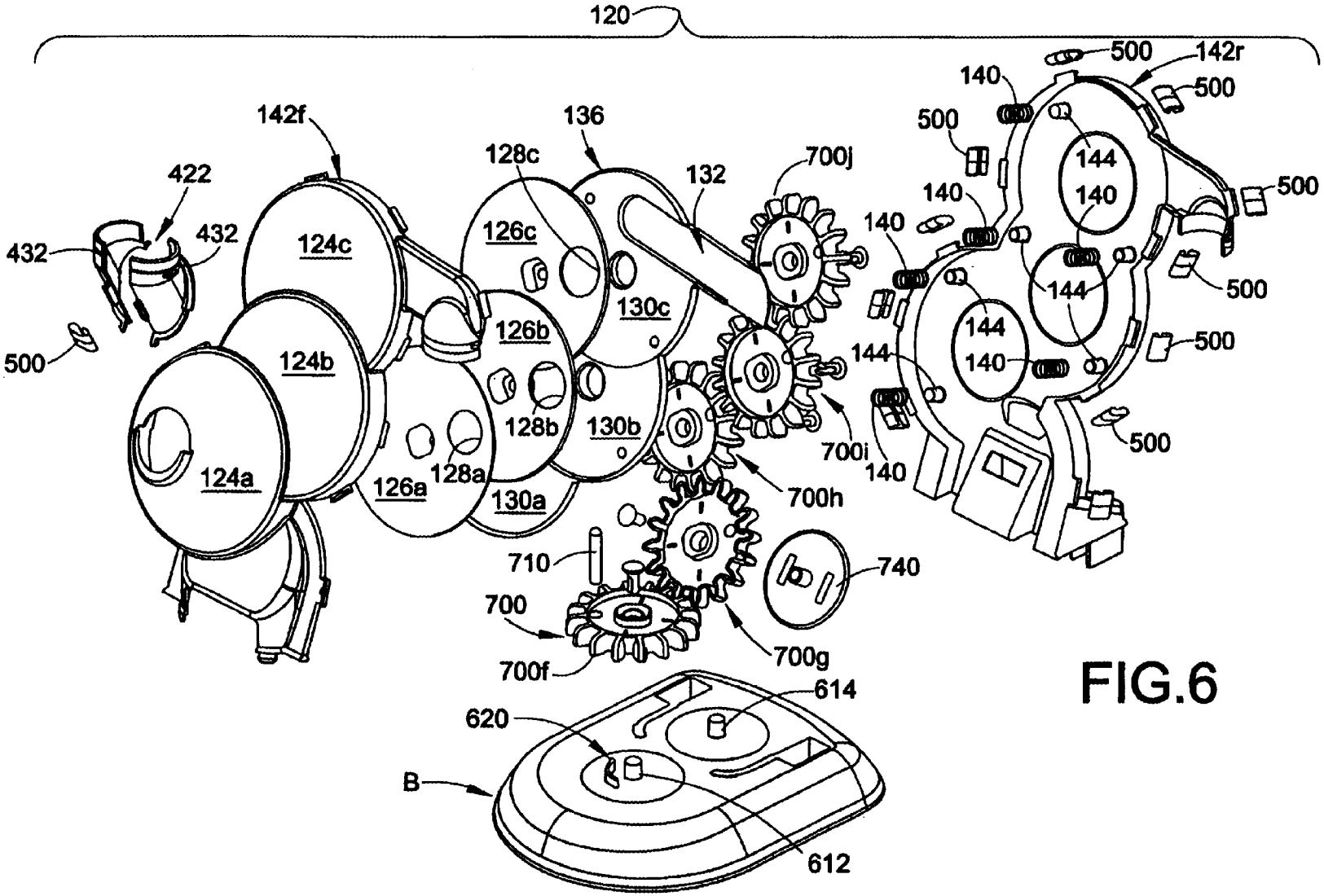
FIG. 6 is an exploded perspective view of the second coin handling module illustrated in FIG. 4.

Turning now to FIGS. 4–6, a second coin handling module 120 is supported on a base B and includes an inlet 122 adapted to receive coins from an upstream module or any other source. The coin inlet 122 communicates with a first coin disc housing 124*a* which includes a coin transfer disc 126*a* therein supported for clockwise rotation (as indicated by the arrow R4) in a manner similar to the disc 26 described above in that coins from the inlet 122 pass into the disc housing 124*a* and are individually received in an opening 128*a* in the disc 126*a*. Again, the disc 126*a* lies closely adjacent a rear wall 130*a* of the housing 124*a* and is of a controlled minimum thickness so that coins are individually stripped from the inlet 122 and received in the opening 128*a*. Also, the housing 124*a* and disc 126*a* are inclined rearwardly as is seen in FIG. 5 so that coins are supported in the opening 128*a* by the rear wall 130*a*.

The second module 120 also includes second and third coin disc housings 124*b* and 124*c* which support coin transfer discs 126*b*,126*c* therein for counter-clockwise and clockwise rotation, respectively, as shown by arrows R5,R6. The second and third coin disc housings 124*b*,124*c* and discs 126*b*,126*c* are substantially similar to each other and to the first coin disc housing and disc 124*a*,126*a*. However, the second and third coin disc housings 124*b*,124*c* are arranged so that the second coin disc 126*b* is vertically above and partially overlapping the first coin disc 126*a*. Likewise, the third coin disc 126*c* is vertically above and partially overlaps the second coin disc 126*b*. The discs 126*a*–126*c* are not co-planer but are parallel and lie closely adjacent where they overlap. The second and third coin discs 126*b*,126*c* also lie closely adjacent rear walls 130*b*,130*c*, respectively, and are conformed so that only a single coin is received in their respective openings 128*b*,128*c*, as described above. Preferably, the openings 128*a*–128*c* increase slightly in diameter from the disc 126*a* to the disc 126*c* and the openings 128*b*,128*c* are elongated and defined by beveled edges to facilitate coin movement into and out of these openings. Also, timing marks and/or arrows (not shown) may be placed on the discs 126*a*–126*c* to facilitate assembly and to ensure proper interaction therebetween.

With particular reference to FIG. 6, the rear walls 130*a*–130*c* are preferably formed in a single plate 136. Furthermore, to ensure that each disc 126*a*–126*c* lies closely adjacent its respective rear wall 130*a*–130*c*, a plurality of biasing springs 140 are positioned between the plate 136 and a rear housing member 142*r* of the module 120. Preferably, the springs 140 are coil springs and are received on bosses 144 projecting outwardly from the rear housing member 142*r*.

The first and second discs 126*a*,126*b* counter-rotate. The discs 126*a*,126*b* are also arranged so that, as the first disc 126*a* rotates clockwise along arrow R4 and carries a coin upwardly in its opening 128*a*, the openings 128*a*,128*b* will be placed in registry so that, due to the rearward inclination of the discs 126*a*,126*b*, the coin in the opening 126*a* passes into the second coin disc housing 124*b* and is received in the second coin disc opening 128*b*.

Likewise, the second and third discs 128*b*,128*c* counter-rotate and are arranged so that, as the second disc 126*b* rotates counter-clockwise along arrow R5 and carries a coin upwardly in its opening 128*b*, the openings 128*b*,128*c* will be placed in registry. When this occurs, the coin will pass from the opening 128*b* into the third disc housing 124*c* and be received by the opening 128*c* in the third disc 126*c*.

As the third disc 126*c* rotates clockwise along arrow R6, the coin in the opening 128*c* is carried upwardly until the opening 128*c* communicates with an exit chute 132 formed in the rear wall 130*c*. Due to the rearward inclination of the disc 126*c* and wall 130*c*, the coin will pass from the opening 128*c* into the exit chute 132. The exit chute 132 is downwardly inclined and conformed so that a coin received from the third disc 126*c* rolls on its edge downwardly toward a coin exit 134 where the coin exits the second coin handling module 120.

FIGS. 7A–9 illustrate a third coin handling module 220 in accordance with the present invention. The module 220 is also supported on a base B. Coins are received by a coin inlet 222 from an upstream module or any other source. The coin inlet 222 communicates coins to a coin transport ramp housing 224 which includes a stepped ramp or incline 226 defined therein by a first housing member 228*a* and a mating rear housing member 228*b*. As is shown in FIG. 8, the stepped ramp 226 includes a central space which accommodates a coin indexing member 230 mounted for reciprocation as indicated along line R7. The stepped ramp 226 is defined by a plurality of individual, successive steps 240. The coin indexing member 230 is likewise defined by plural, individual, successive steps or coin pushing members 242. The coin indexing member 230 reciprocates along line R7 between a retracted position (FIG. 8) where in each of its steps 242 are retracted relative to an associated step of the ramp 226, and an extended or pushing position wherein each of its steps 242 move forward (away from the inlet 222) and upward so that a coin C is indexed forwardly and upwardly to a successive step 240 as shown in broken lines. Preferably, the coin C is not flipped over as it moves from its first step 240 to a next, successive step 240. The coin indexing member 230 is retracted and the process is then repeated so that the coin C travels upward in a step-wise manner to a coin outlet 250 where it exits the third module 220. The front and rear housing members 228*a*,228*b* preferably define a downwardly sloped ramp 252 to feed the coin C from the stepped ramp 226 to the outlet 250.

In a similar manner, the housings 228*a*,228*b* define an inlet ramp 254 to the housing 224 which provides a platform to support one or more coins C. It is important that the pushing member 242 of the coin indexing member 230 associated with the inlet ramp 254 extend upward above the ramp 254 only a sufficient distance to push a single coin from the ramp 254 to the next step 240. In this manner, even if multiple coins are stacked on the ramp 254, coins will be individually stripped from the bottom of such a stack up the stepped ramp 226. A cover 260 covers the coin ramp housing 224.

Figure 7A:
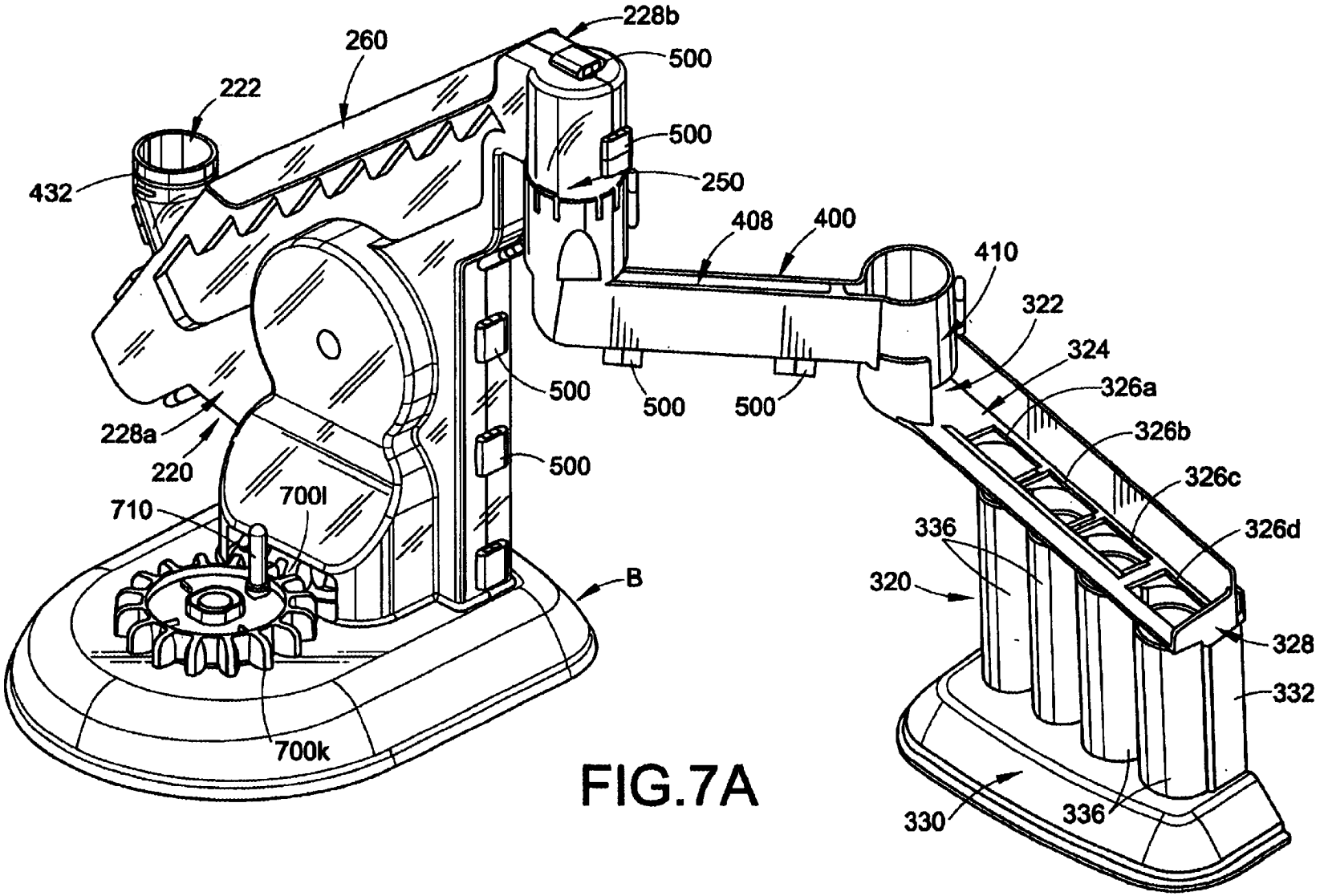
FIG. 7A is a perspective view of a third coin handling module formed in accordance with the present invention and connected to a coin sorting module by way of a coin connector.
Figure 10A:
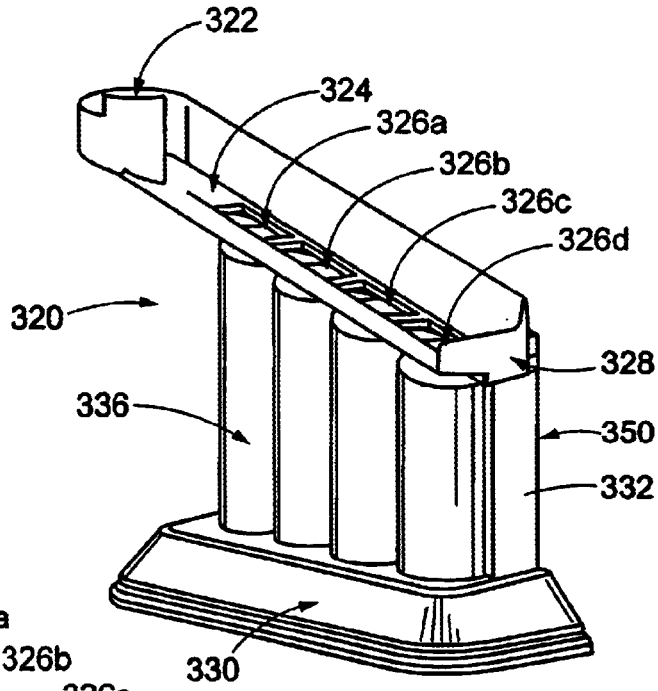
FIG. 10A is a perspective view of a coin sorting module formed in accordance with the present invention.
Figure 10B:
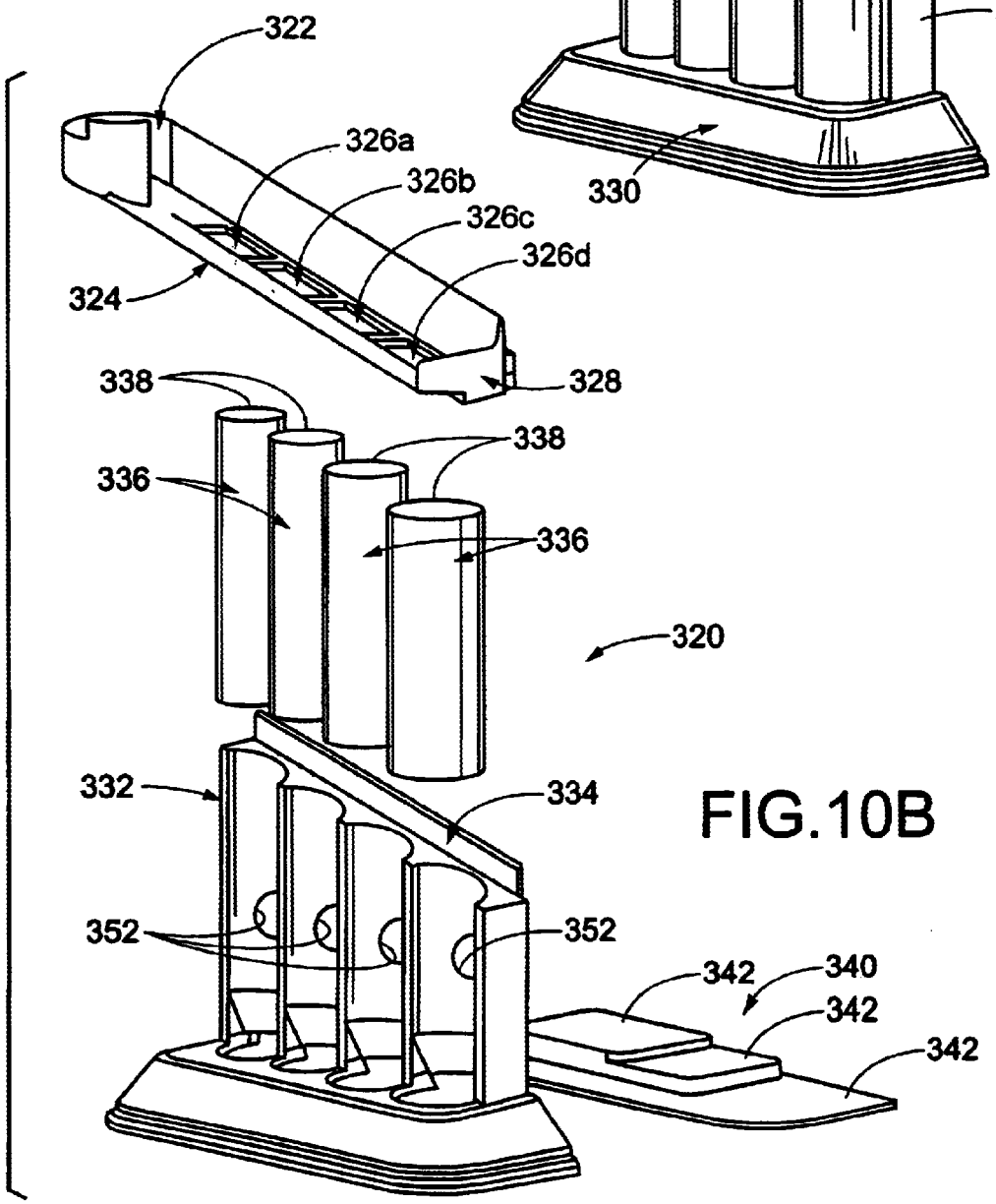
FIG. 10B is an exploded perspective view of the coin sorting module of FIG. 10A.

FIGS. 7A, 10A, and 10B illustrate a coin sorting module 320 formed in accordance with the present invention. The coin sorting module 320 comprises a coin inlet 322 which receives unsorted coins and passes same to a downwardly inclined ramp or slide 324. As is generally known in the coin sorting arts, the slide 324 includes a plurality of openings 326*a*–326*d* arranged in order of increasing size from the inlet 322 downwardly toward a lower portion 328 of the slide 324. In this manner, unsorted coins slide down the ramp 324 on one of their faces and drop through the first one of the openings 326*a*–326*d* which is sufficiently large to allow its passage. Of course, more or less openings 326*a*–326*d* may be provided depending upon the number of denominations of coins to be sorted.

The slide 324 is fixedly supported on a base 330. In particular, the base 330 includes a coin container receiving section 332 which fixedly supports the slide on an upper inclined edge 334 thereof. The coin container receiving section 332 also releasably receives and retains a plurality of coin tubes or containers 336 for placement underneath each of the openings 326*a*–326*d*, respectively, so that sorted coins are received in the containers 336 and retained in a stack. Optionally, a coin wrapper may first be placed in each container 336 so that the sorted coins are wrapped as they are sorted. The coin containers 336 are seated upon a pedestal member 340 which forms a part of the base 330 and includes platforms 342 of differing heights so that the upper edges 338 of the coin containers 336 are positioned at decreasing heights so that the slide 340 can be positioned just vertically above each coin container 336. A rear wall 350 of the coin container receiving section 332 includes a finger-access opening 352 associated with each coin container 336 so that a user is able to push each container 336 outward, away from the wall 350, for ease of removal of the container 336 from the base 330. Those of ordinary skill in the art will recognize that any other coin sorter may be used to sort coins together with the modules 20,120,220 without departing from the overall scope and intent of the present invention.

Figure 11A:
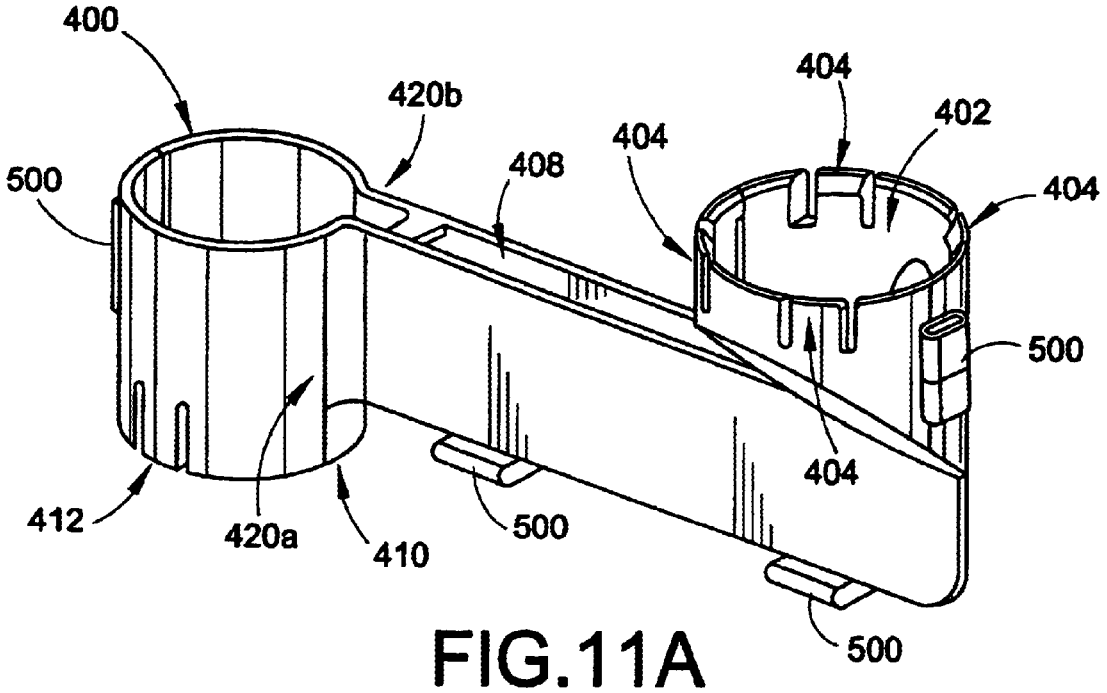
FIGS. 11A and 11B are, respectively, perspective and cross-sectional views of a coin connector formed in accordance with the present invention, the coin connector being used with the modules of FIGS. 1, 4, and 7.
Figure 11B:
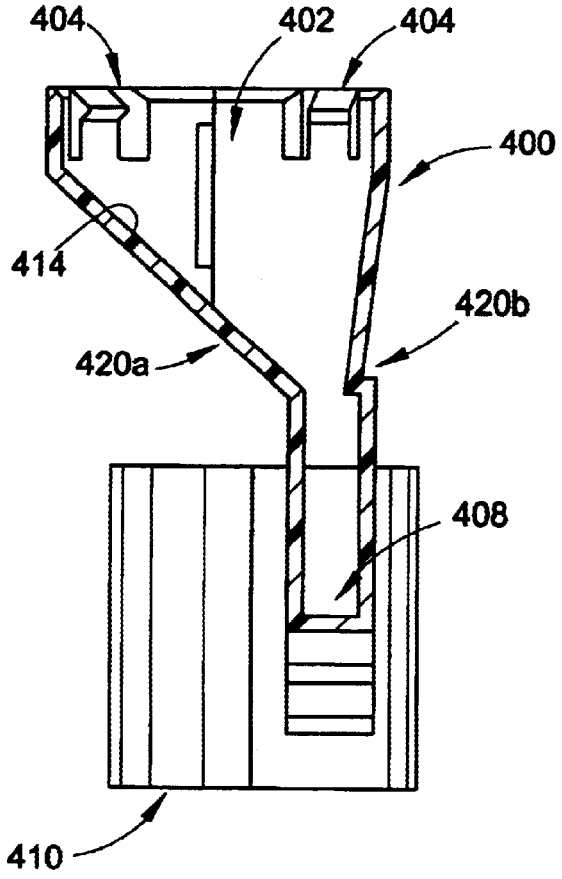

With reference now to FIGS. 11A and 11B, a coin connector 400 in accordance with the present invention is illustrated. The coin connector 400 is used to interconnect an outlet of each coin handling module 20, 120,220 to a successive or downstream module 20,120,220, or to the sorting module 320 as shown in FIG. 7A. Alternatively, two or more of the modules 20,120,220 may be connected in succession to circulate coins in an endless loop. The coin connector 400 comprises an inlet 402 shaped to mate with the outlets 52,134,250 of the modules 20,120,220, respectively. The ramp inlet 402 can simply frictionally engage each outlet 52,134,250 for a secure connection thereto, but preferably includes resilient fingers or bite-teeth 404 for engaging a groove 430 in the module 20,120,220.

The coin connector 400 includes a coin transport channel 408 which transports coins from the inlet 402 to an outlet 410. The outlet 410 of the coin connector ramp 400 is adapted for mating connection with the inlet 22,122,222,322 of any other module 20,120,220,320 to transfer coins to the subject module. When connected between adjacent modules, the coin transport channel 400 slopes downwardly from the inlet 402 to the outlet 410. The outlet 410 can simply frictionally mate with an inlet 20,120,220,320 or may include resilient bite teeth 412 which engage a groove 432 (FIGS. 1, 6, and 9) on the inlet to ensure a secure connection. Alternatively, the connector outlet 410 may be vertically spaced above one of the inlets 22,122,222,322, and be interconnected by a vertical tube or simply vertically aligned with the inlet. As indicated in FIGS. 1 and 4, this arrangement allows the coin connector 400 to pivot as indicated by arrow R9, preferably through an arc of at least approximately 300°. A pivotable connection between the coin connector 400 and the modules 20,120,220,320 being interconnected, allows the modules to be placed in any desired arrangement, including the aforementioned endless loop.

The coin transport channel 408 is adapted to receive coins in a manner where they are standing on their edges so that each received coin rolls on its edge from the region of the inlet 402 to the outlet 410. To ensure that coins enter the channel 408 in the proper orientation for rolling, the inlet 402 comprises a coin deflector ramp 414 which slopes downwardly into the channel 408. The ramp 414 forces coins entering the inlet 402 to be flipped or deflected onto their edges when they slide into the channel 408. In this manner, effective and efficient transport of coins from one module 20,120,220 to another module 20,120,220,320 is ensured. Those of ordinary skill in the art will also recognize that the modules 20,120,220 may be connected for passage of coins therebetween or to the sorter module 320 by any other suitable ramp, tube, or simple vertical alignment therebetween without assistance from any ramp, tube, or like connector. Also, the inlet 402 of each coin connector 400 is designed to mate and communicate with the outlet 410 of another coin connector 400. Therefore, it should be recognized that, by placing an upstream module 20,120,220 on an elevated pedestal or the like, a plurality of coin connectors 400 can be interconnected in succession for purposes of conveying coins from the upstream module 20,120,220 to a downstream module 20,120,220,320.

Figure 3A:
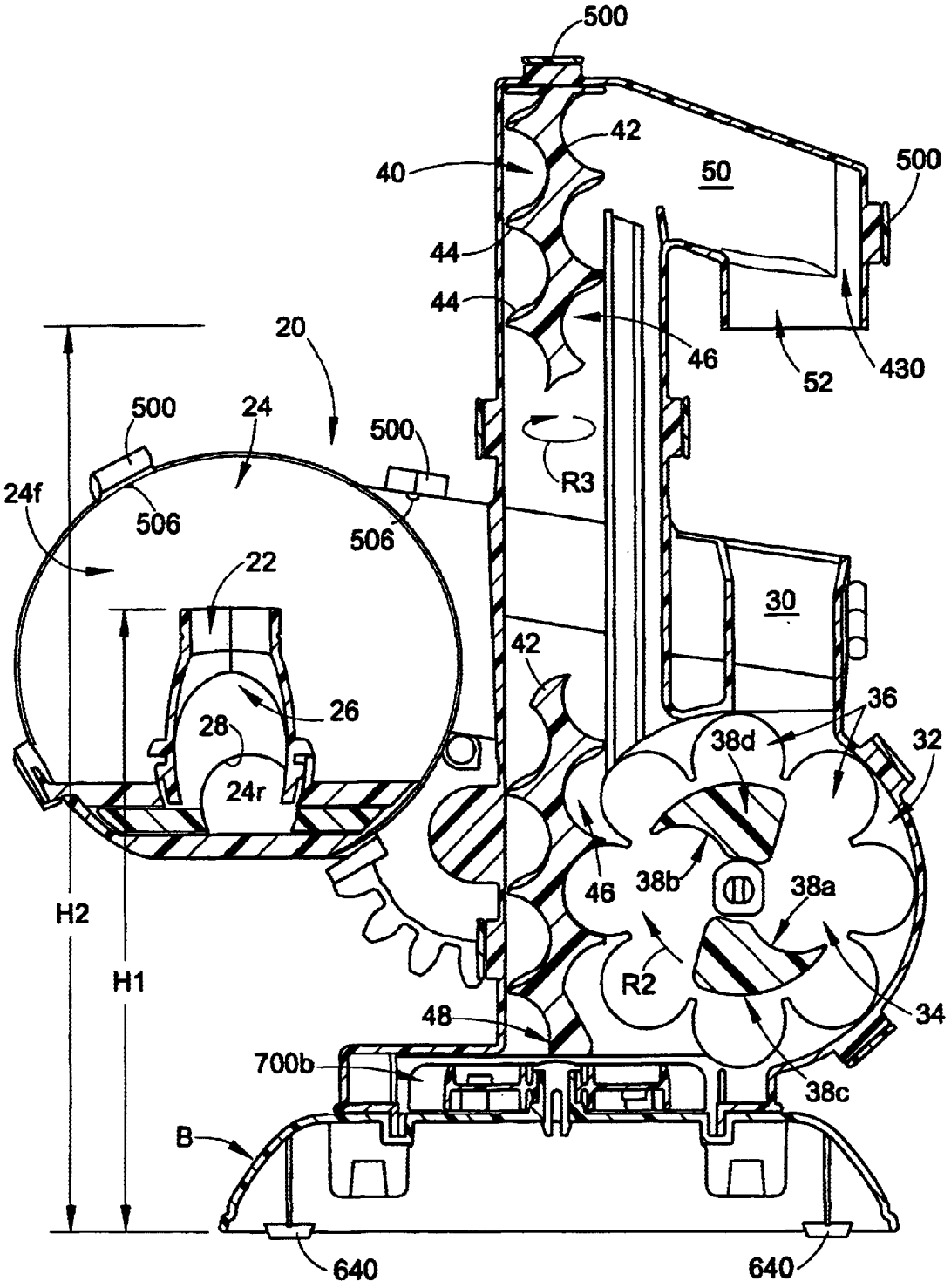
FIG. 3A is a front cross-sectional view of the first coin handling module shown in FIG. 1.
Figure 12A:
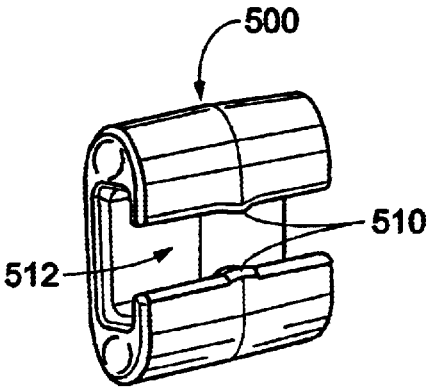
FIG. 12A is a perspective view of a fastening C-clip formed in accordance with the present invention.
Figure 12B:
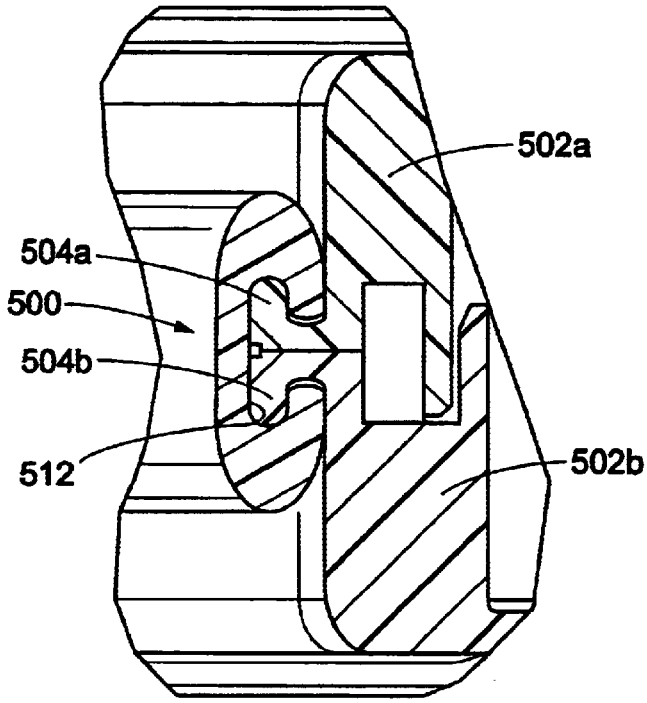
FIG. 12B is a partial cross-sectional perspective view of the fastening C-clip of FIG. 12A in its operative position for securing two coin handling module housing portions together.

The various housing members of each module 20,120, 220,320, and the coin connector ramps 400 are preferably secured together using a plurality of C-clips 500 as particularly illustrated in FIGS. 12A and 12B. With general reference to FIG. 12B, two housing members 502*a*,502*b* to be joined are formed so that peripheral L-shaped tabs 504*a*, 504*b* respectively on each housing member 502*a*,502*b* lie adjacent or abut and form a T-shaped projection when the housing members 502*a*,502*b* are mated. Preferably, as shown in FIG. 3A, each tab 504*a*,504*b* of each housing member is formed with a central groove 506 therein. The C-clips 500 correspondingly include central nibs 510 at opposite clip ends which are received in the grooves 506 of the mated tabs 504*a*,504*b* when a clip is installed so that the T-shaped projection formed by the mating tabs is received in the open, central section 512 of the clip 500 as illustrated in FIG. 12B.

The housing members joined in this manner, as generally illustrated in FIG. 12B and as described above, include the front and rear housing members 20*f*,20*r* of the first module 20, the front and rear housing members 142*f*,142*r* of the second module 120, the front and rear housing members 228*a*,228*b* of the third module 220, and the front and rear sections 420*a*,420*b* of the coin connector 400. In this manner, a positive and secure construction is achieved without use of fasteners requiring tightening and loosening by tools. The clip 500 facilitates convenient assembly and disassembly of the relevant housing sections to increase enjoyment by an end-user.

Figure 13:
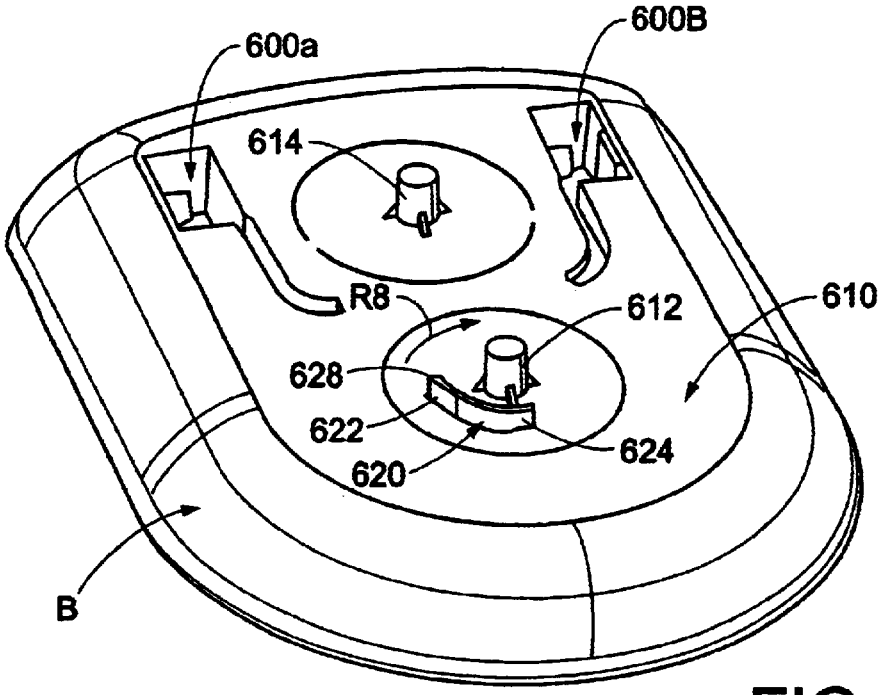
FIG. 13 is a perspective view of a base for supporting the first, second, or third coin handling module in accordance with the present invention; and, FIGS. 14A and 14B are front and rear perspective views, respectively, of a gear formed in accordance with the present invention.

Another feature that facilitates assembly of the various coin handling modules 20,120,220 is that each is preferably supported on an identical base B. The base B is illustrated individually in FIG. 13 and includes slots 600*a*,600*b* or other means for receiving and frictionally retaining the front and rear housing members of each module 20,120,220 so that the module 20,120,220 extends vertically upward from the horizontal base B. Any other suitable means may be used to secure the modules 20,120,220 to a base B.

Figure 9:
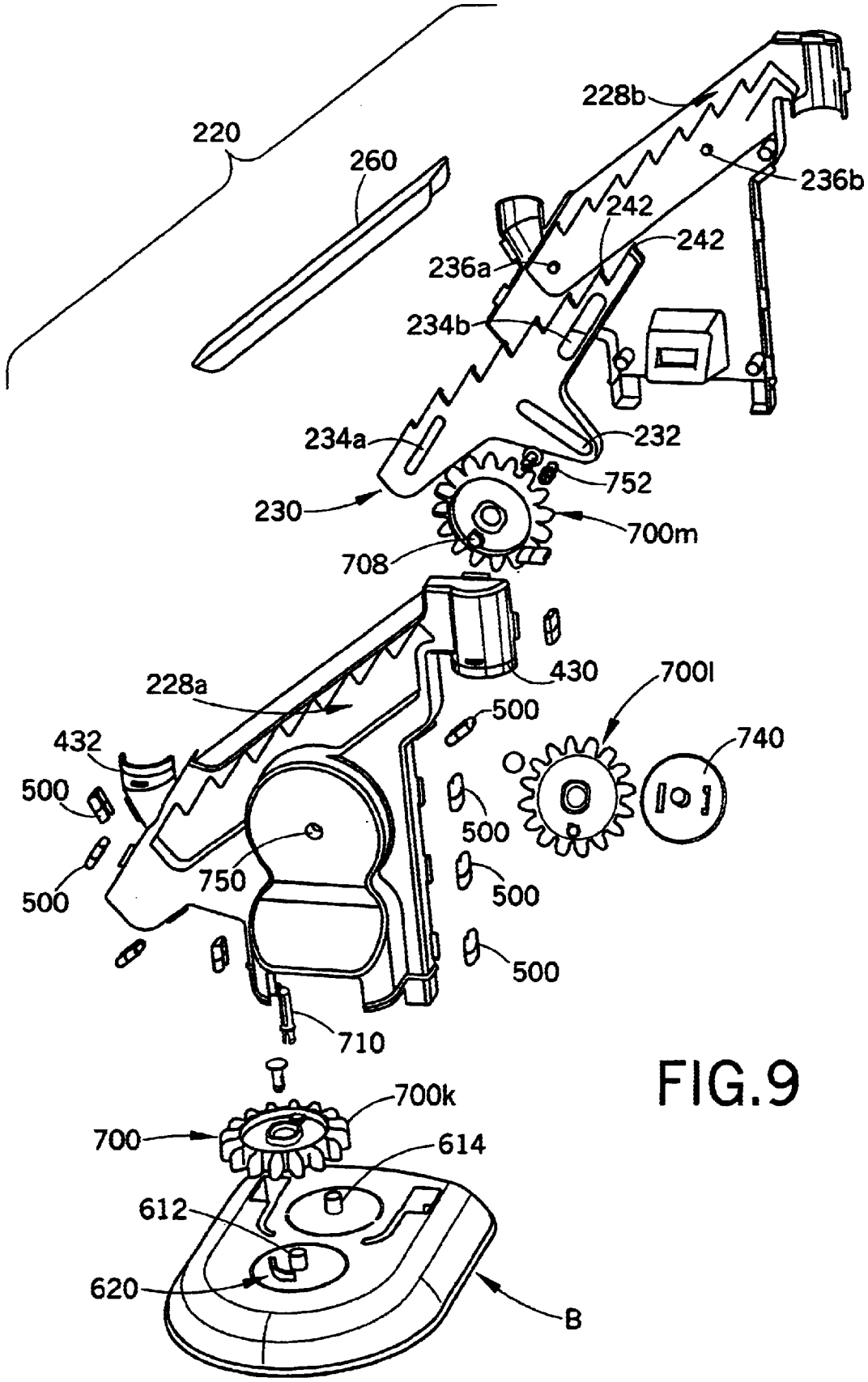
FIG. 9 is an exploded perspective view of the third coin handling module as shown in FIG. 7.
Figure 14A:
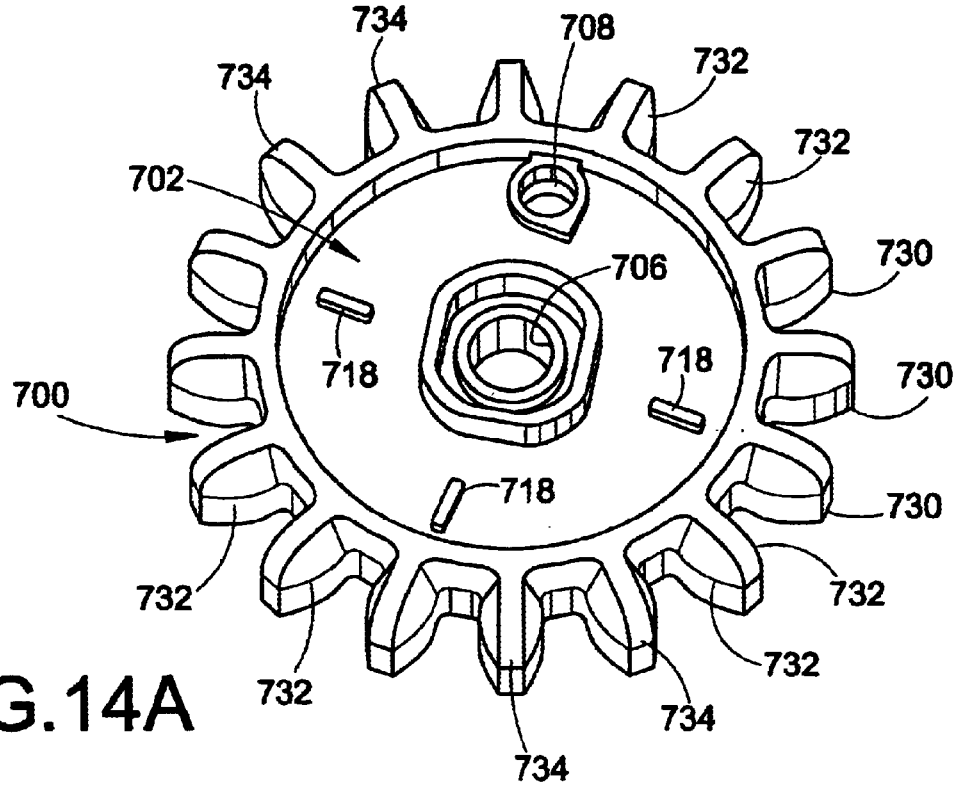
Figure 14B:
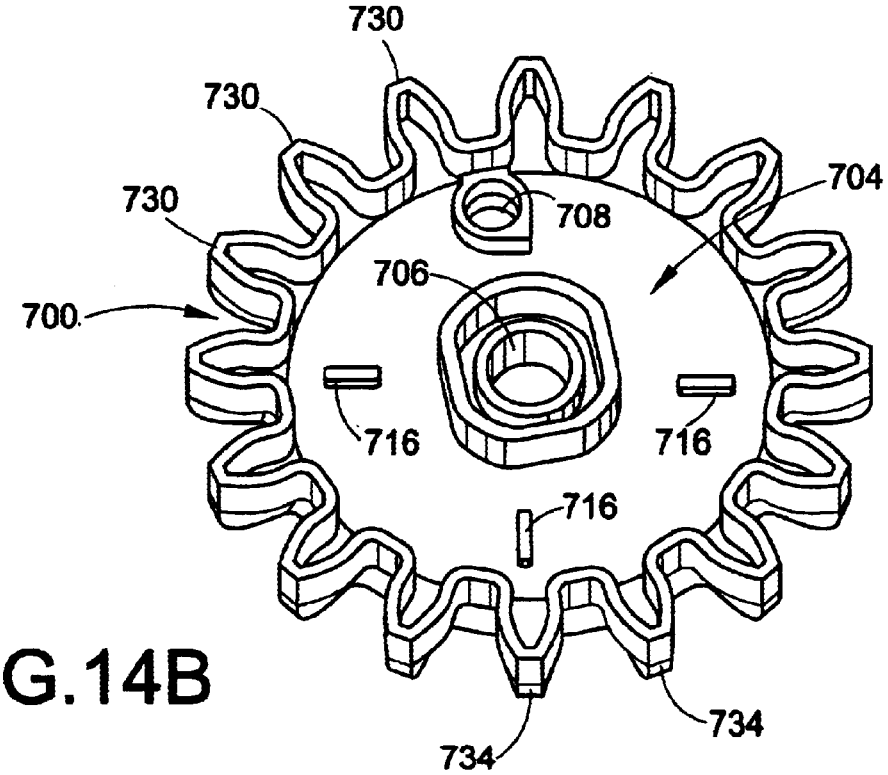

An upper surface 610 of each base B includes first and second bosses 612,614 projecting upwardly therefrom, each adapted to rotatably support a drive gear 700 as illustrated in FIGS. 1, 4, and 9. A clutch member 620 projects upwardly from the surface 610 of the base B in the region of the first boss 612 and includes a first end 622 and a second end 624. The first end 622 deflects radially inward toward the boss 612 upon application of pressure to an outer surface 626 of the clutch member. With reference now also to FIGS. 14A and 14B, a drive gear 700 formed in accordance with the present invention is illustrated and includes an upper surface 702 and a lower surface 704. The gear 700 includes a central opening 706 for being received on the bosses 612,614. A second opening 708, spaced radially from the central opening 706, frictionally receives a drive stem 710 (FIGS. 1, 4, 9) for gripping by a user to effect manual rotation of the gear 700.

At least one and, preferably, a plurality of radial ribs 716 project downwardly from the lower surface 704 of the gear 700. These ribs 716 are arranged, so that when a gear 700 is supported on the boss 612, the ribs coact with the clutch member 620 to allow a unidirectional rotation of the gear 700. In particular, as illustrated herein, upon clockwise rotation of a drive gear, as illustrated by arrow R8 in FIG. 13, relative to the boss 612, the ribs 716 pass the end 624 of the clutch member 620 and follow the outer surface 626 of the member 620. The end 622 deflects radially inward to allow the ribs to travel therepast. On the other hand, the clutch member 620 includes a face or stopping surface 628 which engages the ribs 716 upon attempted counter-clockwise rotation of the gear 700. This prevents accidental reverse operation of any of the modules 20,120,220. Also, the base B is preferably fitted with a plurality of non-skid feet 640 (FIG. 3A) to inhibit sliding movement of the base B and associated module relative to a floor, table, counter, or other support surface. Also, as shown in FIG. 14A, each gear 700 preferably comprises a plurality of ribs 718 projecting from the upper surface 702. The ribs 718 are similar or identical to the ribs 716 and cooperate with the clutch 620 in the same manner as the ribs 716 in the event that a user places a gear 700 on the boss 612 in an inverted manner—i.e., with the gear upper surface 702 adjacent the surface 610 of base B.

Each module 20,120,220 preferably utilizes one or more gears 700 to drive coin movement therethrough as described. To simplify construction by an end-user, the gears 700 are preferably conformed to be universally used at any location in any module 20,120,220 as needed. As illustrated in FIGS. 14A and 14B, the preferred gear includes peripheral spur teeth 730 which include rounded or beveled regions 732 blending or connecting with the upper gear surface 702. Furthermore, the outermost edge of each tooth 730, at the upper surface 702, also comprises a smoothly rounded or radiused surface 734. Such gear geometry facilitates driving engagement between two gears 700 whether they are co-planer or engaged such that an angle less than 180° is formed between their respective upper surfaces 702.

Figure 2:
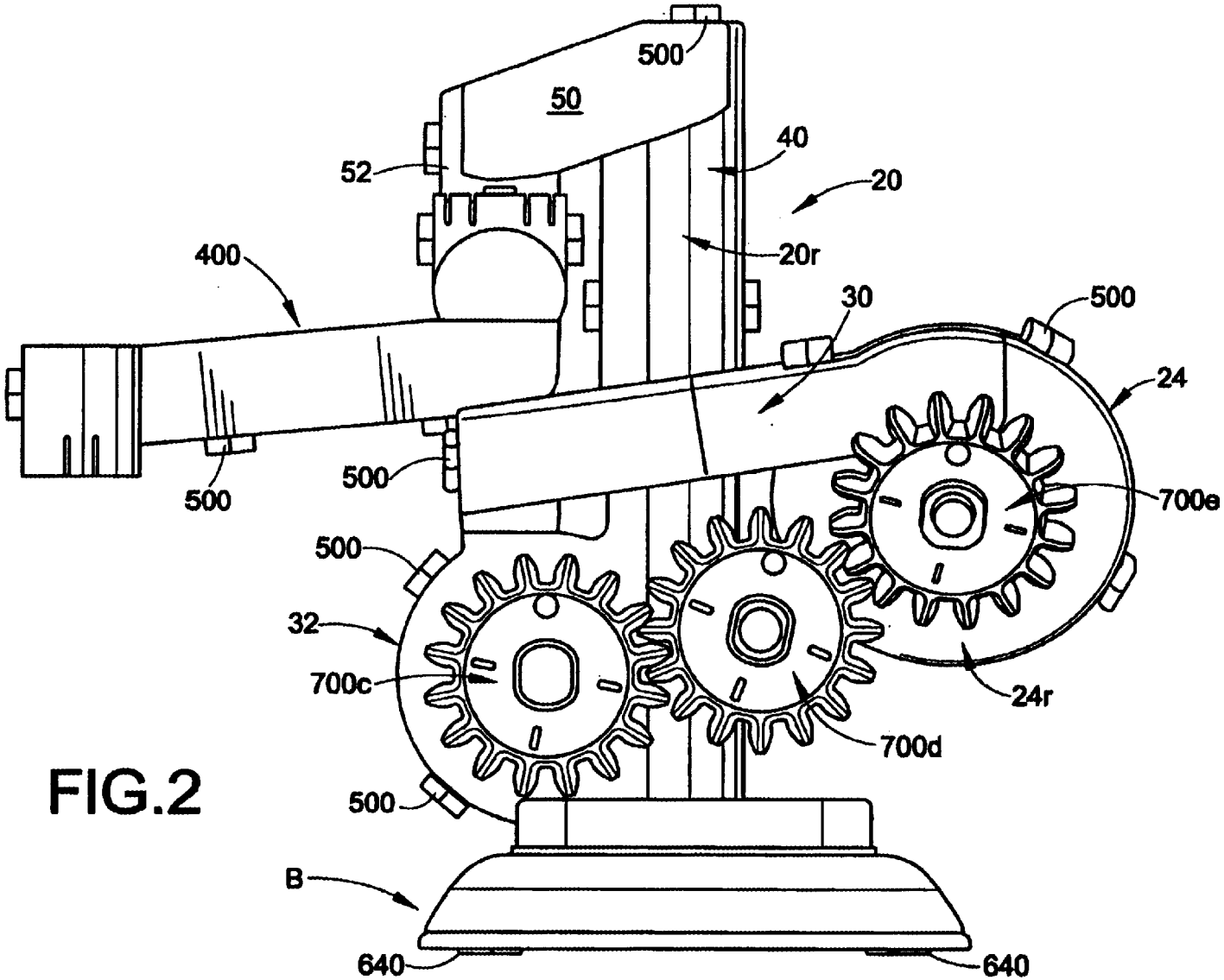
FIG. 2 is a rear elevational view of the first coin handling module shown in FIG. 1.

Referring again to FIGS. 1–3A, the first coin handling module 20 comprises a plurality of preferably identical gears 700 to effect movement of the coin disc 26, the drive-disc 32, and the coin auger 42. More particularly, an input gear 700*a* is rotatably supported on the base B and includes a drive stem 710 projecting upwardly out of the opening 708. A second gear 700*b* is supported on the second boss 614 of the base B and is directly engaged or otherwise drivingly coupled with the first gear 700*a*. With reference to FIGS. 3A and 3B, the coin auger 42 includes a lower end 48 adapted to engage the central opening 706 of the second gear 700*b* so that the auger 42 and gear 700*b* rotate together. Because the petals 36 of the drive-disc 34 are successively engaged with the auger 42, rotation along arrow R3 of the auger 42 causes rotation along arrow R2 of the drive-disc 34. As illustrated in FIG. 2, the drive-disc 34 is keyed to rotate with a third gear 700*c*. The gear 700*c* is engaged with a fourth gear 700*d* which is, in turn, engaged with a fifth gear 700*e*. The fifth gear 700*e* is connected to rotate with the first coin disc 26.

In operation, a user grips the stem 710 and rotates the first gear 700*a* in a single direction as permitted by the clutch mechanism 620. Rotation of the first gear 700*a* causes rotation of the second gear 700*b* and auger 42. Rotation of the auger 42 drives the drive-disc 34 through the petals 36 which, in turn, drives the coin disc 26 through the gear train 700*c*–700*e*. The horizontal orientation of the input gear 700*a* inhibits accidental tipping of the module 20 when a user manually rotates the gear 700*a*.

Referring to FIGS. 4–6, it is shown that the second module 120 likewise preferably utilizes plural like gears 700 to effect rotation of the discs 126*a*,126*b*,126*c*. In particular, a first or input gear 700*f* is rotatably secured on the first boss 612 and includes the projecting input stem 710 for manual rotation thereof. A second gear 700*g* is not mounted on the boss 614, but is rotatably mounted on an angled adapter 740 which is affixed to the rear housing member 142*r*. The second gear 700*g* is also engaged with a third gear 700*h* which is connected to rotate with the first coin transfer disc 126*a*. The third gear 700*h* is also engaged with a fourth, co-planar gear 700*i* which drives the second coin transfer disc 126*b*. Finally, the fourth gear 700*i* is engaged with a fifth, co-planar gear 700*j* which drives the third coin transfer disc 126*c*.

Figure 7B:
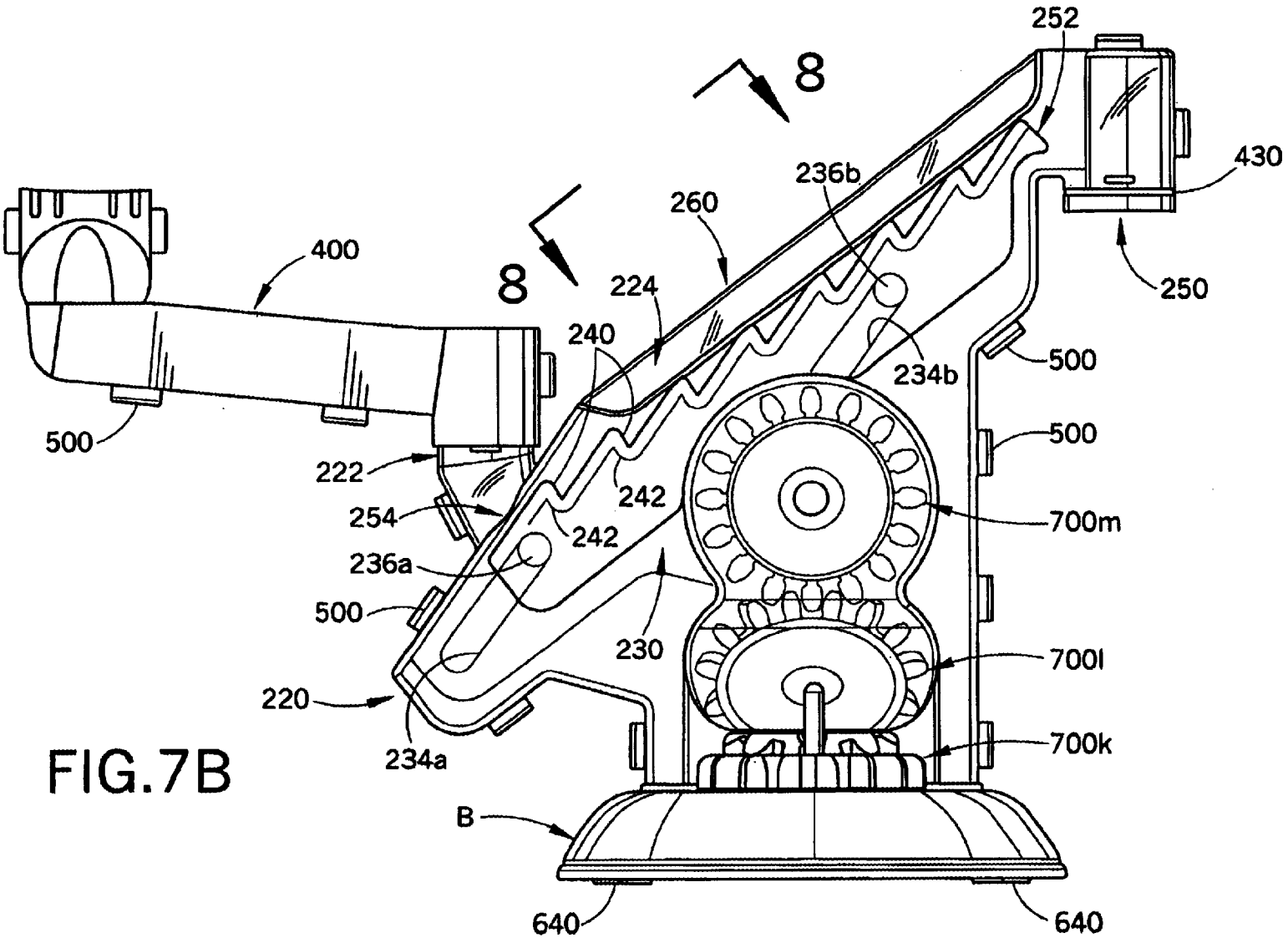
FIG. 7B is a rear elevational view of the third coin handling module shown in FIG. 7A, the illustrated module having a transparent housing.

With reference to FIGS. 7 and 9, the third module 220 also utilizes plural gears 700 to effect the reciprocation of the coin indexing member 230. More particularly, a first gear 700*k* is rotatably supported by the first boss 612 of the base B for uni-directional manual rotation via stem 710. A second gear 700*l* is mounted to an angle adapter 740 and is engaged with the first gear 700*k*. The second gear is also engaged with a third gear 700*m* which is rotatably mounted to a boss 750 on the inner surface of the housing first member 228*a*. A follower or drive stud 752 projects outwardly from the opening 708 in the third gear 700*m* and is slidably received in an angled cam slot 232 formed in the coin indexing member 230. The coin indexing member 230 is supported for reciprocation R7 relative to the housing member 228*b* via bosses 236*a*,236*b* received respectively in angled slots 234*a*,234*b* of the indexing member 230. Accordingly, rotation of the first gear 700*k* results in rotation of the second and third gear 700*l*,700*m*. Rotation of the third gear 700*m* results in reciprocation of the indexing member 230 due to engagement of the stud 752 with the angled cam slot 232. The slots 234*a*,234*b* limit the amount of reciprocal movement of the indexing member 230.

It is preferable, though not mandatory, that the coin inlets 22,122,222,322 of the modules 20,120,220,320 be located at an equal height H1 (FIG. 3A) above a common support surface such as a floor or table. Likewise, it is preferable that the outlets 52,134,250 be located at an equal height H2, which is greater than the height H1.

All of the modules 20,120,220,320, the base B, gears 700, connectors 400, and other components described herein are preferably manufactured from a conventional molded plastic, and most preferably from clear or transparent molded plastic so that the passage of coins through each module is readily observable.

The invention has been described with reference to preferred embodiments. Obviously, modifications and alterations will occur to others upon reading and understanding the preceding specification. It is intended that the invention be construed as including all such modifications and alterations insofar as they come within the scope of the appended claims or the equivalents thereof.

Having thus described the preferred embodiments, the invention is claimed to be:

1. A coin handling device comprising:

a support base for supporting a module on an associated support surface;

an input gear rotatably supported on said base;

a contact surface defined on said input gear for contact by a user to effect manual rotation of said input gear;

a coin inlet located at a first elevation above said associated support surface;

a coin outlet located at a second elevation above said associated support surface, wherein said second elevation is greater than said first elevation;

a coin transport mechanism adapted for transporting coins from said inlet at said first elevation to said outlet at said second elevation in response to manual rotation of said input gear, at least a portion of said coin transport mechanism moving coins against a gravitational force.

2. The coin handling device of claim 1 further comprising a clutch mechanism acting on said input gear so that said input gear is rotatable in only a first direction.

3. The coin handling device as set forth in claim 2 wherein said input gear includes at least one projection extending therefrom, and wherein said clutch mechanism comprises:

a resilient member connected to said base and adapted to deflect radially upon contact with said at least one projection extending from said input gear when said input gear is rotated in said first direction, said resilient member including a stop surface adapted to contact said at least one projection extending from said input gear and prevent rotation of said input gear when rotation of said input gear in a second direction is attempted.

4. The coin handling device as set forth in claim 1 wherein said at least one coin connector comprises:

a connector inlet adapted for pivotable connection to said outlet of said upstream module;

a connector outlet adapted for pivotable connection to said inlet of said downstream module; and, a coin transport channel connecting said connector inlet and outlet and conformed to support coins on their edges so that coins in said channel roll from said connector inlet to said connector outlet.

5. The coin handling device as set forth in claim 4, wherein said connector inlet comprises a coin deflecting ramp inclined downwardly toward said coin transport channel for deflecting coins deposited into said connector inlet onto their edges as the deposited coins pass from said inlet to said channel.

6. The coin handling device as set forth in claim 4 wherein said at least one coin connector comprises:

resilient bite-teeth in the region of said connector inlet adapted to engage an indentation in said upstream module in the region of said upstream module outlet; and, resilient bite-teeth in the region of said connector outlet adapted to engage and indentation in said downstream module in the region of said downstream module inlet.

7. The coin handling device as set forth in claim 1 wherein each of said first and second coin handling modules comprises:

a front housing member including a plurality of tabs spaced about and extending from a peripheral portion thereof;

a rear housing member adapted to mate with said front housing member and including a plurality of tabs spaced about and extending from a peripheral portion thereof in locations corresponding to the locations of said tabs extending from said front housing member so that said tabs of said front and rear housing members abut and, together, form projections; and, a plurality of clips adapted for releasable connection to said projections, respectively, to maintain said tabs of said front and rear housing members in abutment.

8. The coin handling device as set forth in claim 7 wherein each of said tabs is L-shaped and includes an outwardly facing groove therein, said abutting tabs forming said projection with a T-shaped cross-section, and wherein said clip is a C-clip including first and second nibs extending respectively from opposite ends thereof, each of said nibs adapted for receipt in a groove of a tab when said C-clip is installed so that the associated T-shaped projection is received in an open, central section of said clip.

9. A coin handling device comprising:

a first support structure;

a first coin handling module, comprising a first housing defining a first internal space, mounted on said first support structure, said first module including: (i) a first inlet for receiving coins into said first internal space, (ii) a first outlet for dispensing coins out of said first internal space, (iii) a first manual input force drive system comprising a first manually movable input member located external to said first internal space, and, (iv) a first coin transport mechanism located in said first internal space for conveying coins individually within said first internal space from said first inlet to said first outlet, at least a portion of said first coin transport mechanism conveying coins against a gravitational force in response to manual user movement of said first input member;

a second support structure spaced from said first support structure;

a second coin handling module, comprising a second housing defining a second internal space, mounted on said second support structure, said second module including: (i) a second inlet for receiving coins into said second internal space, (ii) a second outlet for dispensing coins out of said second internal space, (iii) a second manual input force drive system comprising a second manually movable input member located external to said second internal space, and, (iv) a second coin transport mechanism located in said second internal space for conveying coins individually within said second internal space from said second inlet to said second outlet, at least a portion of said second coin transport mechanism conveying coins against a gravitational force in response to manual user movement of said second input member; and, at least one coin connector located external to and extending between said first and second housings, said at least one coin connector comprising a connector inlet, a connector outlet and a transport channel extending between said connector inlet and said connector outlet and adapted for conveying coins by gravity from said connector inlet to said connector outlet, said connector inlet in communication with said first outlet of said first module and said connector outlet in communication with said second inlet of said second module, said at least one coin connector adapted for conveying coins by gravity from the first outlet to the second inlet.

10. A coin handling device comprising:

a support base adapted for placement on an associated support surface;

a housing supported on said base, said housing including: a coin inlet for receiving coins into said housing at a first elevation above said associated support surface and a coin outlet for dispensing coins from said housing at a second elevation above said support surface, wherein said second elevation is greater than said first elevation;

a coin transport mechanism mounted in said housing and adapted for transporting coins from said coin inlet to said coin outlet of said housing; and, a manually operable drive system mounted on at least one of said support base and said housing, said drive system being operatively connected to said coin transport mechanism to operate said coin transport mechanism, wherein said coin transport mechanism comprises:

an upwardly inclined and stepped coin transport ramp connecting said coin inlet and said coin outlet, said ramp including a plurality of steps and divided by a longitudinally extending space; and, a coin indexing member mounted for reciprocation in said longitudinally extending space and including a coin pushing member associated with each step of said coin transport ramp, whereby coins deposited in said inlet are indexed up said stepped coin transport ramp toward said outlet and are dispensed at said outlet.

11. An apparatus for handling coins comprising:

first and second separate coin handling modules each including: (i) an inlet at a first elevation for receiving coins, (ii) an outlet at a second elevation for dispensing coins from said module, wherein said second elevation is greater than said first elevation, (iii) a manually operable drive system, and, (iv) a coin transport mechanism for conveying coins individually from said inlet upwardly to said outlet in response to user operation of said manually operable drive system; and, a coin connector including a connector inlet connected to said outlet of said first module to receive coins from said outlet of said first module and a connector outlet connected to said inlet of said second module for supplying coins from said connector to said inlet of said second module, said coin connector conveying coins by gravity from said first module to said second module, wherein said connector inlet is located at a third elevation and said connector outlet is located at a fourth elevation, wherein said fourth elevation is less than said third elevation.

12. The coin handling device of claim 11, wherein said drive system comprises a manually rotatable input gear and wherein said coin handling device further comprises a clutch mechanism acting on said input gear so that said input gear is rotatable only in a first direction in response to user applied manual force.

13. The coin handling device of claim 11 wherein said connector further comprises a coin transport channel connecting said connector inlet and said connector outlet.

14. The coin handling device of claim 13, wherein said coin transport channel supports coin on their edges so that coins in said channel roll from said connector inlet to said connector outlet.

* * * * *